US007401020B2

(12) United States Patent
Eide

(10) Patent No.: US 7,401,020 B2
(45) Date of Patent: Jul. 15, 2008

(54) APPLICATION OF EMOTION-BASED INTONATION AND PROSODY TO SPEECH IN TEXT-TO-SPEECH SYSTEMS

(75) Inventor: Ellen M. Eide, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 775 days.

(21) Appl. No.: 10/306,950

(22) Filed: Nov. 29, 2002

(65) Prior Publication Data

US 2004/0107101 A1 Jun. 3, 2004

(51) Int. Cl.
*G10L 19/00* (2006.01)

(52) U.S. Cl. ..... 704/258; 704/260

(58) Field of Classification Search ..... 704/258, 704/260

See application file for complete search history.

(56) References Cited

U.S. PATENT DOCUMENTS 5,940,797 A * 8/1999 Abe ..... 704/260
6,358,055 B1 * 3/2002 Rothenberg ..... 434/185
6,845,358 B2 * 1/2005 Kibre et al. ..... 704/260
2003/0028380 A1 * 2/2003 Freeland et al. ..... 704/260
2003/0055653 A1 * 3/2003 Ishii et al. ..... 704/275
2003/0163320 A1 * 8/2003 Yamazaki et al. ..... 704/270

OTHER PUBLICATIONS

R.E. Donovan et al., "Current Status of the IBM Trainable Speech Synthesis System", Proc. 4th ISCA Tutorial and Research Workshop on Speech Synthesis, Atholl Palace Hotel, Scotland, 2001.

* cited by examiner

*Primary Examiner*—Daniel D Abebe
(74) *Attorney, Agent, or Firm*—Ference & Associates LLC

(57) ABSTRACT

A text-to-speech system that includes an arrangement for accepting text input, an arrangement for providing synthetic speech output, and an arrangement for imparting emotion-based features to synthetic speech output. The arrangement for imparting emotion-based features includes an arrangement for accepting instruction for imparting at least one emotion-based paradigm to synthetic speech output, as well as an arrangement for applying at least one emotion-based paradigm to synthetic speech output.

4 Claims, 4 Drawing Sheets

PLAIN TEXT:

HELLO, IT'S NICE TO FINALLY MEET YOU, ALTHOUGH I WAS VERY SORRY TO HEAR ABOUT YOUR ORDEAL.

MARKED-UP TEXT:

<EXPRESSIVE EMOTION=LIVELY LEVEL=2>

HELLO, IT'S NICE TO FINALLY MEET YOU,

<\EXPRESSIVE>

<EXPRESSIVE EMOTION=CONCERN LEVEL=3>

ALTHOUGH I WAS

<\EXPRESSIVE>

<EXPRESSIVE EMOTION=CONCERN LEVEL=4>

VERY

<\EXPRESSIVE>

<EXPRESSIVE EMOTION=CONCERN LEVEL=3>

SORRY TO HEAR ABOUT YOUR ORDEAL.

<\EXPRESSIVE>

FIG. 4

APPLICATION OF EMOTION-BASED INTONATION AND PROSODY TO SPEECH IN TEXT-TO-SPEECH SYSTEMS

FIELD OF THE INVENTION

The present invention relates generally to text-to-speech systems.

BACKGROUND OF THE INVENTION

Although there has long been an interest and recognized need for text-to-speech (TTS) systems to convey emotion in order to sound completely natural, the emotion dimension has largely been tabled until the voice quality of the basic, default emotional state of the system has improved. The state of the art has now reached the point where basic TTS systems provide suitably natural sounding in a large percentage of synthesized sentences. At this point, efforts are being initiated towards expanding such basic systems into ones which are capable of conveying emotion. So far, though, that capability has not yet yielded an interface which would enable a user (either a human or computer application such as a natural language generator) to conveniently specify an emotion desired.

SUMMARY OF THE INVENTION

In accordance with at least one presently preferred embodiment of the present invention, there is now broadly contemplated the use of a markup language to facilitate an interface such as that just described. Furthermore, there is broadly contemplated herein a translator from emotion icons (emoticons) such as the symbols :-) and :-( into the markup language.

There is broadly contemplated herein a capability provided for the variability of "emotion" in at least the intonation and prosody of synthesized speech produced by a text-to-speech system. To this end, a capability is preferably provided for selecting with ease any of a range of "emotions" that can virtually instantaneously be applied to synthesized speech. Such selection could be accomplished, for instance, by an emotion-based icon, or "emoticon", on a computer screen which would be translated into an underlying markup language for emotion. The marked-up text string would then be presented to the TTS system to be synthesized.

In summary, one aspect of the present invention provides a text-to-speech system comprising: an arrangement for accepting text input; an arrangement for providing synthetic speech output; an arrangement for imparting emotion-based features to synthetic speech output; the arrangement for imparting emotion-based features comprising: an arrangement for accepting instruction for imparting at least one emotion-based paradigm to synthetic speech output; and an arrangement for applying at least one emotion-based paradigm to synthetic speech output.

Another aspect of the present invention provides a method of converting text to speech, the method comprising the steps of: accepting text input; providing synthetic speech output; imparting emotion-based features to synthetic speech output; the step of imparting emotion-based features comprising: accepting instruction for imparting at least one emotion-based paradigm to synthetic speech output; and applying at least one emotion-based paradigm to synthetic speech output.

Furthermore, an additional aspect of the present invention provides a program storage device readable by machine, tangibly embodying a program of instructions executable by the machine to perform method steps for converting text to speech, the method comprising the steps of: accepting text input; providing synthetic speech output; imparting emotion-based features to synthetic speech output; the step of imparting emotion-based features comprising: accepting instruction for imparting at least one emotion-based paradigm to synthetic speech output; and applying at least one emotion-based paradigm to synthetic speech output.

For a better understanding of the present invention, together with other and further features and advantages thereof, reference is made to the following description, taken in conjunction with the accompanying drawings, and the scope of the invention will be pointed out in the appended claims.

BRIEF DESCRIPTION OF THE DRAWINGS

FIG. 4 provides an example of speech output infused with added emotional markers.

DESCRIPTION OF THE PREFERRED EMBODIMENTS

There is described in Donovan, R. E. et al., "Current Status of the IBM Trainable Speech Synthesis System," Proc. 4th ISCA Tutorial and Research Workshop on Speech Synthesis, Atholl Palace Hotel, Scotland, 2001 (also available from [http://]www.ssw4.org, at least one example of a conventional text-to-speech systems which may employ the arrangements contemplated herein and which also may be relied upon for providing a better understanding of various background concepts relating to at least one embodiment of the present invention.

Generally, in one embodiment of the present invention, a user may be provided with a set of emotions from which to choose. As he or she enters the text to be synthesized into speech, he or she may thus conceivably select an emotion to be associated with the speech, possibly by selecting an "emoticon" most closely representing the desired mood.

The selection of an emotion would be translated into the underlying emotion markup language and the marked-up text would constitute the input to the system from which to synthesize the text at that point.

In another embodiment, an emotion may be detected automatically from the semantic content of text, whereby the text input to the TTS would be automatically marked up to reflect the desired emotion; the synthetic output then generated would reflect the emotion estimated to be the most appropriate.

Also, in natural language generation, knowledge of the desired emotional state would imply an accompanying emotion which could then be fed to the TTS (text-to-speech) module as a means of selecting the appropriate emotion to be synthesized.

Figure 1:
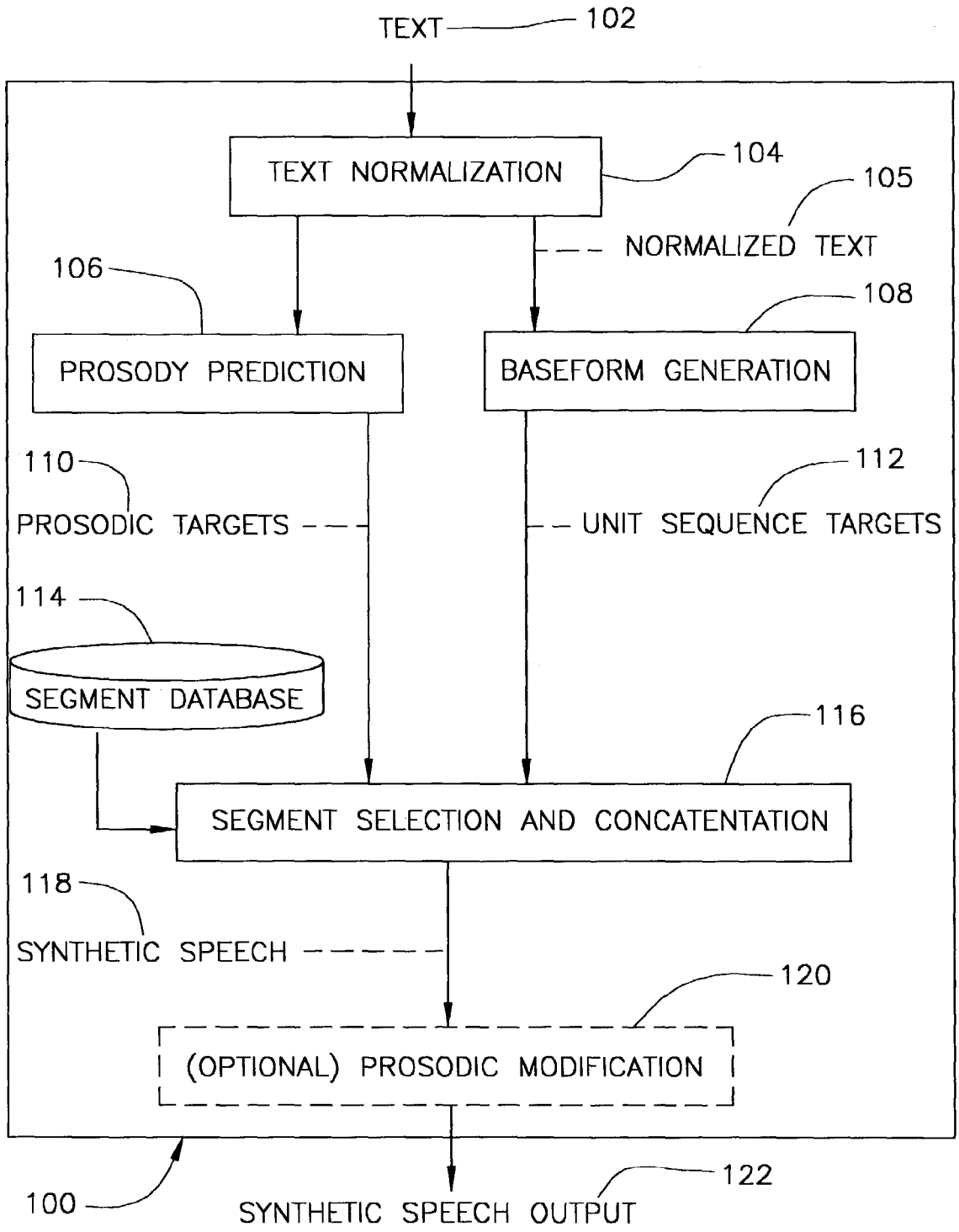
FIG. 1 is a schematic overview of a conventional text-to-speech system.

Generally, a text-to-speech system is configured for converting text as specified by a human or an application into an audio file of synthetic speech. In a basic system 100, such as shown in FIG. 1, there may typically be an arrangement for text normalization 104 which accepts text input 102. Normalized text 105 is then typically fed to an arrangement 108 for baseform generation, resulting in unit sequence targets fed to an arrangement for segment selection and concatenation (116). In parallel, an arrangement 106 for prosody (i.e., word stress) prediction will produce prosodic "targets" 110 to be fed into segment selection/concatenation 116. Actual segment selection is undertaken with reference to an existing segment database 114. Resulting synthetic speech 118 may be modified with appropriate prosody (word stress) at 120; with our without prosodic modification, the final output 122 of the system 100 will be synthesized speech based on original text input 102.

Conventional arrangements such as illustrated in FIG. 1 do lack a provision for varying the "emotional content" of the speech, e.g., through altering the intonation or tone of the speech. As such, only one "emotional" speaking style is attainable and, indeed, achieved. Most commercial systems today adopt a "pleasant" neutral style of speech that is appropriate, e.g., in the realm of phone prompts, but may not be appropriate for conveying unpleasant messages such as, e.g., a customer's declining stock portfolio or a notice that a telephone customer will be put on hold. In these instances, e.g., a concerned, sympathetic tone may be more appropriate. Having an expressive text-to-speech system, capable of conveying various moods or emotions, would thus be a valuable improvement over a basic, single expressive-state system.

Figure 2:
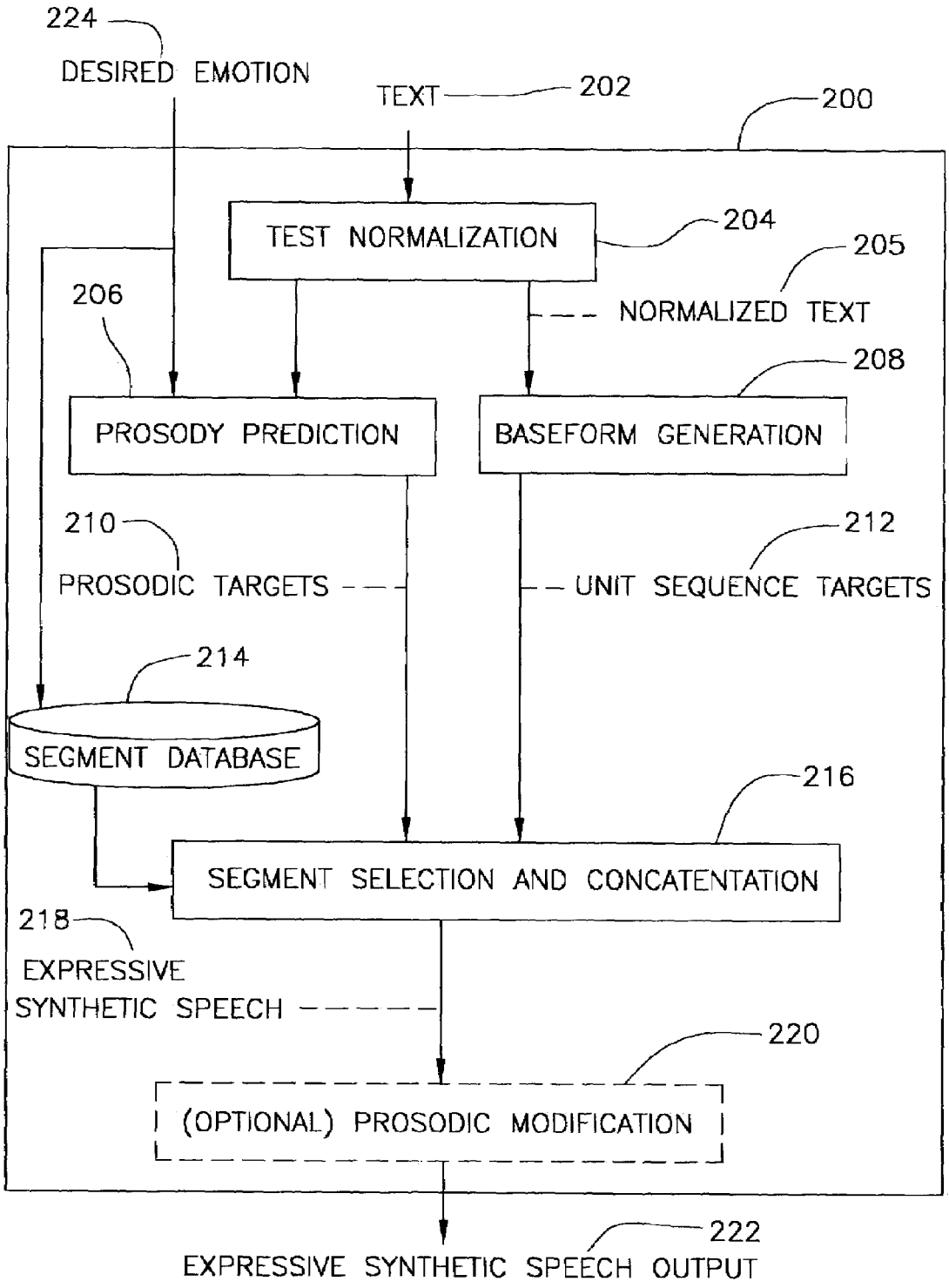
FIG. 2 is a schematic overview of a system incorporating basic emotional variability in speech output.

In order to provide such a system, however, there should preferably be a provided to the user or the application driving the text-to-speech an arrangement or method for communicating to the synthesizer the emotion intended to be conveyed by the speech. This concept is illustrated in FIG. 2, where the user specifies both the text and the emotion that he/she intends. (Components in FIG. 2 that are similar to analogous components in FIG. 1 have reference numerals advanced by 100.) As shown, a desired "emotion" or tone of speech desired by the user, indicated at 224, may be input into the system in essentially any suitable manner such that it informs the prosody prediction (206) and the actual segments 214 that may ultimately be selected. The reason for "feeding in" to both components is that emotion in speech can be reflected both in prosodic patterns and in non-prosodic elements of speech. Thus, a particular emotion might not only affect the intonation of a word or syllable, but might have an impact on how words or syllables are stressed; hence the need to take into account the selected "emotion" in both places.

For example, the user could click on a single emoticon among a set thereof, rather than, e.g., simply clicking on a single button which says "Speak."

Figure 3:
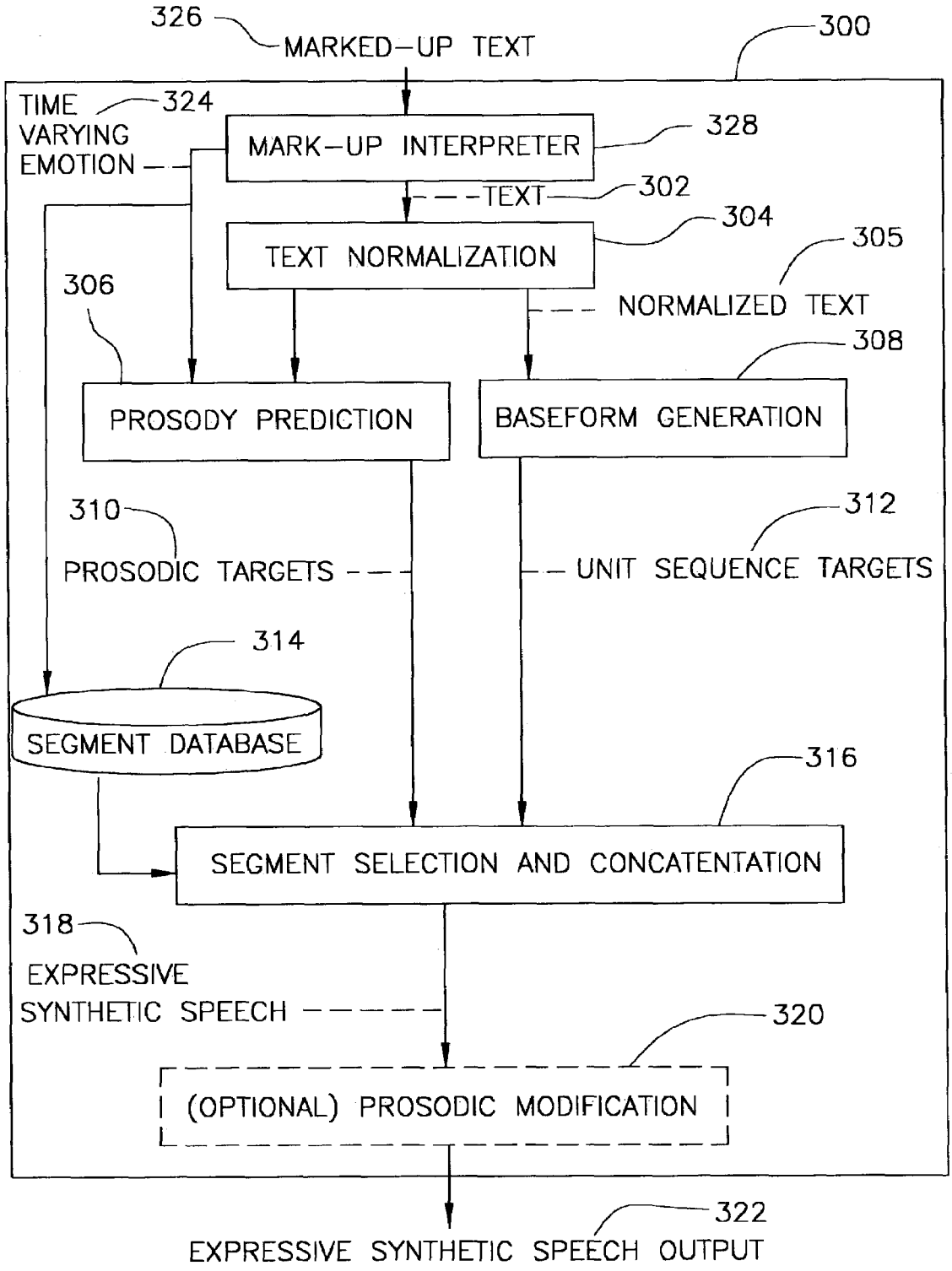
FIG. 3 is a schematic overview of a system incorporating time-variable emotion in speech output.

It is also conceivable for a user to change the emotion or its intensity within a sentence. Thus, there is presently contemplated, in accordance with a preferred embodiment of the present invention, an "emotion markup language", whereby the user of the TTS system may provide marked-up text to drive the speech synthesis, as shown in FIG. 3. (Components in FIG. 3 that are similar to analogous components in FIG. 2 have reference numerals advanced by 100.) Accordingly, the user could input marked-up text 326, employing essentially any suitable mark-up "language" or transcription system, into an appropriately configured interpreter 328 that will then both feed basic text (302) onward per normal while extracting prosodic and/or intonation information from the original "marked-up" input and thusly conveying a time-varied emotion pattern 324 to prosody prediction 306 and segment database 314.

An example of marked-up text is shown in FIG. 4. There, the user is specifying that the first phrase of the sentence should be spoken in a "lively" way, whereas the second part of the statement should be spoken with "concern", and that the word "very" should express a higher level of concern (and thus, intensity of intonation) than the rest of the phrase. It should be appreciated that a special case of the marked-up text would be if the user specified an emotion which remained constant over an entire utterance. In this case, it would be equivalent to having the markup language drive the system in FIG. 2, where the user is specifying a single emotional state by clicking on an emoticon to synthesize a sentence, and the entire sentence is synthesized with the same expressive state.

Several variations of course are conceivable within the scope of the present invention. As discussed heretofore, it is conceivable for textual input to be analyzed automatically in such a way that patterns of prosody and intonation, reflective of an appropriate emotional state, are thence automatically applied and then reflected in the ultimate speech output.

It should be understood that particular manners of applying emotion-based features or paradigms to synthetic speech output, on a discrete, case-by-case basis, are generally known and understood to those of ordinary skill in the art. Generally, emotion in speech may be affected by altering the speed and/or amplitude of at least one segment of speech. However, the type of immediate variability available through a user interface, as described heretofore, that can selectably affect either an entire utterance or individual segments thereof, is believed to represent a tremendous step in refining the emotion-based profile or timbre of synthetic speech and, as such, enables a level of complexity and versatility in synthetic speech output that can consistently result in a more "realistic" sound in synthetic speech than was attainable previously.

It is to be understood that the present invention, in accordance with at least one presently preferred embodiment, includes an arrangement for accepting text input, an arrangement for providing synthetic speech output and an arrangement for imparting emotion-based features to synthetic speech output. Together, these elements may be implemented on at least one general-purpose computer running suitable software programs. These may also be implemented on at least one Integrated Circuit or part of at least one Integrated Circuit. Thus, it is to be understood that the invention may be implemented in hardware, software, or a combination of both.

If not otherwise stated herein, it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A method of converting text to speech, said method comprising the steps of:

accepting text input;

providing synthetic speech output corresponding to the text input;

imparting emotion-based features to synthetic speech output;

said step of imparting emotion-based features comprising:

accepting instruction for imparting at least one emotion-based paradigm to synthetic speech output, wherein said step of accepting instruction further comprises accepting emotion-based commands from a user interface; and applying at least one emotion-based paradigm to synthetic speech output, said step of applying at least one emotion-based paradigm to synthetic speech output comprising:

altering at least one segment to be used in synthetic speech output, whereby emotion in speech is reflected in how individual words or syllables are stressed;

altering at least one prosodic pattern to be used in synthetic speech output, whereby emotion in speech is reflected in prosodic patterns; and selectably applying a single emotion-based paradigm over a single utterance of synthetic speech output; or applying a variable emotion-based paradigm over individual segments of an utterance of synthetic speech output.

2. The method according to claim 1, wherein said step of accepting instruction comprises accepting commands from an emotion-based markup language associated with the user interface.

3. The method according to claim 1, wherein said step of applying at least one emotion-based paradigm comprises altering at least one of: prosody, intonation, and intonation intensity in synthetic speech output.

4. The method according to claim 1, wherein said step of applying at least one emotion-based paradigm comprises altering at least one of speed and amplitude in order to affect prosody, intonation and intonation intensity in synthetic speech output.

* * * * *